United States Patent [19]

Jou

[11] Patent Number: 4,856,253

[45] Date of Patent: Aug. 15, 1989

[54] CHANNELLED STRUCTURAL ELEMENT

[76] Inventor: Lin W. Jou, No. 46, Lane 179, Sec. 1, Hai Pien Rd., Tainan, Taiwan

[21] Appl. No.: 214,586

[22] Filed: Jul. 1, 1988

[51] Int. Cl.[4] ..... E04F 19/02

[52] U.S. Cl. ..... 52/717.1; 52/242; 52/287

[58] Field of Search ..... 52/717, 242, 287, 718; 439/110, 120

[56] References Cited

U.S. PATENT DOCUMENTS

| | | | |
|---|---|---|---|
| 3,201,909 | 8/1965 | Grun | 52/717.1 X |
| 4,151,691 | 5/1979 | Wendt | 52/242 |
| 4,527,369 | 7/1985 | Adams | 52/717.1 X |
| 4,593,505 | 6/1986 | Russell | 52/287 X |
| 4,642,957 | 2/1987 | Edwards | 52/717.1 X |

*Primary Examiner*—Henry E. Raduazo
*Assistant Examiner*—Lan Mai
*Attorney, Agent, or Firm*—Morton J. Rosenberg

[57] ABSTRACT

This invention relates to a channelled structural element and in particular to one including a main element having an engaging portion along a central line of the inner side thereof and a groove with an psoen top and a groove with an open bottom at both sides thereof, an auxiliary element provided with a vertically extending portion beside which there is a tenon having a right angle surface and a slot, and a fixed element formed with a hole at the center and a lip at both sides whereby the fixed element is first rigidly mounted on a wall and then the main element is press-fitted into the fixed element and the auxiliary element is engaged with one side of the main element.

1 Claim, 4 Drawing Sheets

CHANNELLED STRUCTURAL ELEMENT

BACKGROUND OF THE INVENTION

Heretofore, pictures and paintings have been widely used for indoor decoration, but they can do nothing to the conceive of the electrical wire. It is, therefore, an object of the present invention to provide a channelled structural element which can be used for indoor decoration as well as concealing the electrical wire.

SUMMARY OF THE INVENTION

This invention relates to a channelled structural element.

It is the primary object of the present invention to provide a channelled structural element which can be used for indoor decoration.

It is another object of the present invention to provide a channelled structural element which can be used to conceal electrical wire.

It is still another object of the present invention to provide a channelled structural element which is inexpensive to fabricate.

It is still another object of the present invention to provide a channelled structural element which is easily constructed.

It is still another object of the present invention to provide a channelled structural element which can be adapted for use with uneven wall.

The novel features which are characteristics of the invention, together with further objects and advantages thereof will be better understood from the following description considered in connection with the accompanied drawings and in which a preferred embodiment of the invention is illustrated by way of example. It is to be expressly understood, however, that the drawings are for the purpose of illustration and description only and not intended as a definition of the limits of the invention.

DETAILED DESCRIPTION OF THE PREFERRED EMBODIMENT

Figure 1:
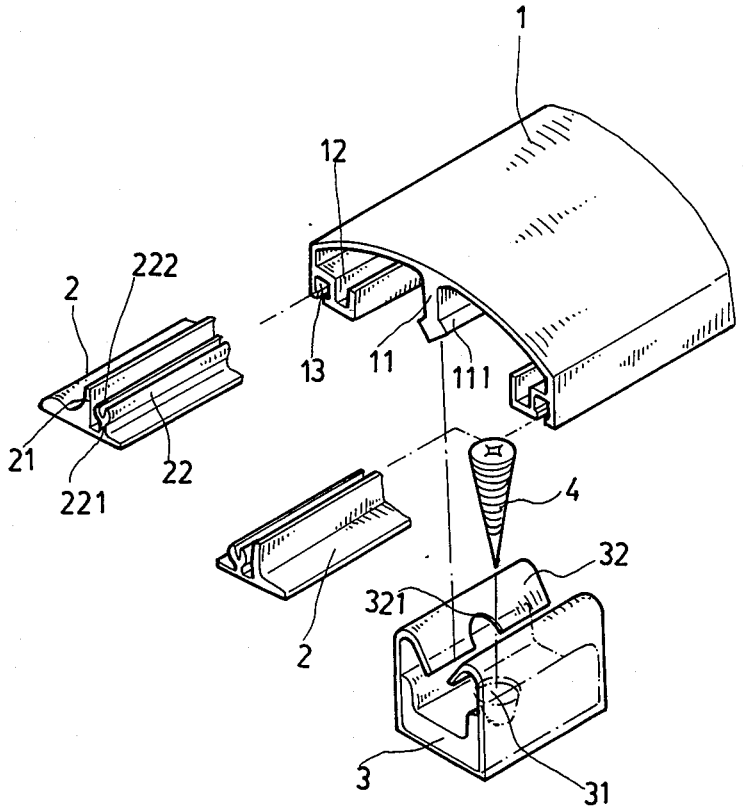
FIG. 1 is an exploded view of a channelled structural elements according to the present invention.

For purposes of promoting an understanding of the principles of the invention, reference will now be made to the embodiment illustrated in the drawings. It will, nevertheless, be understood that no limitation of the scope of the invention is thereby intended, such alternations and further modifications in the illustrated device, and such further applications as would normally occur to one skilled in the art to which the invention relates.

With reference to the drawings and in particular to FIG. 1 thereof, the structural element according to the present invention comprises a main element 1, two auxiliary elements 2 and a fixed element 3. The main element 1 is elongated in shape and has color, pattern or cameo on the outer surface thereof. Along the central line of inner side of the main element, there is an engaging member 11 with stripes 111. At two sides of the main element 1 there are a groove 12 with an oenp top and a groove 13 with an open bottom. The auxiliary element 2 is provided with a vertically extending portion 21 beside which there is a tenon 22 which has a right angle surface 221 and a slot 222. The tenon 22 can be just received into the groove 13. The fixed element 3 is formed with a hole 31 at the center thereof and a lip 32 at both sides. Each lip 32 is provided with a notch 321. The fixed element 3 is rigidly mounted on a wall or the like by a screw 4 through the hole 31 into the wall. The notch 321 is to facilitate the disposition of the screw 4 into the hole 31. Then the engaging portion 11 of the main element 1 is press-fitted into the fixed element 3 the lip 32 of which will keep the main element 1 in position by clamping the engaging portion 11 tightly so that the main element 1 will not be detached from the fixed element 3 unless otherwise pulled out by external force.

Figure 2:
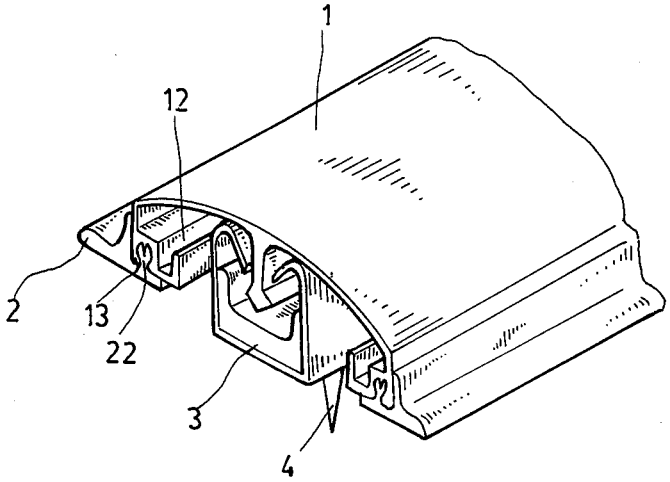
FIG. 2 is a perspective view showing the assembly of the channelled structural elements.
Figure 3:
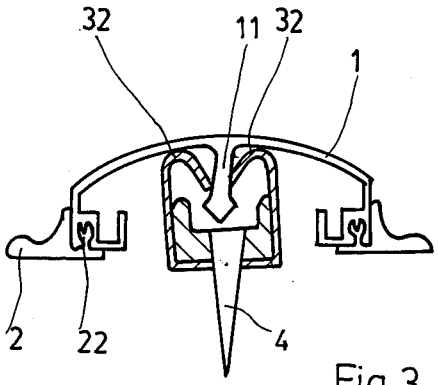
FIG. 3 is a sectional view of the channelled structural elements.
Figure 4:
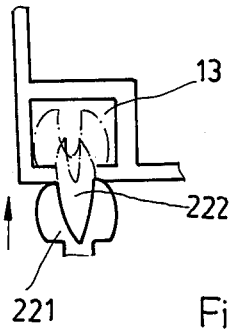
FIG. 4 is an enlarged view showing the connection of the tenon of the auxiliary element and the groove of the main element.
Figure 5:
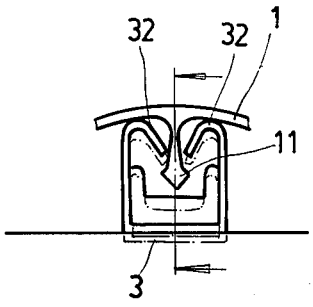
FIG. 5 is a working view showing one end of the structural elements.

On the whole, the fixed element 3 is rigidly mounted on a wall by the screw 4, the main element 1 is press-fitted with the fixed element 3 through the engagement of the engaging portion 11 and the lips 32 of the fixed element 3, and the auxiliary element 2 is press-fitted with the main element 1 with the tenon 22 received into the groove 13. The assembly of the present invention is shown in FIGS. 2 and 3.

Generally, the present invention can be used as a decoration to enclose a picture or the like. Further, the electrical wire can be concealed in the groove 12 of the main element 1 thereby protecting the wire from being damaged as well as decorating the wall.

Figure 6:
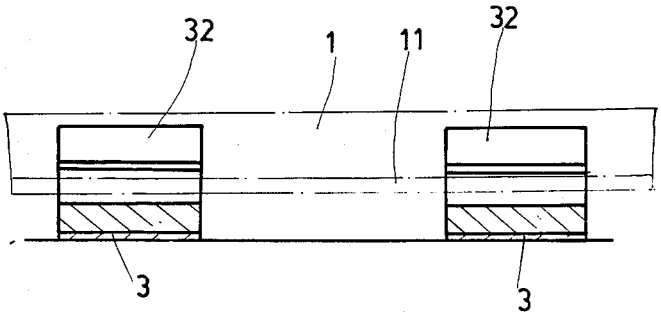
FIG. 6 is a working view of the structural elements.

In case the wall is uneven, since the engaging portion 11 of the main element 1 and the lips 32 of the fixed element 1 are elastic the surface of the main element can still be kept even as shown in FIG. 6.

Although this invention has been described with a certain degree of particularity, it is understood that the present disclosure is made by way of example only and that numerous changes in the construction and the combination and arrangement of parts may be resorted to without departing from the spirit and scope of the invention as hereinafter claimed.

I claim:

1. A structural element comprising:

a main element, elongated in shape, having an engaging portion along a central line of an inner side thereof, and a groove with an open bottom at both sides thereof;

an auxiliary element provided with a vertically extending portion beside which there is a tenon having a right angle surface and a slot, the tenon being able to be just received into the groove with an open bottom of the main element; and a fixed element formed with a hole at a center thereof and a lip at both sides thereof so that the engaging portion of the main element can be press-fitted therein, each lip being provided with a notch for facilitating disposition of a screw into the hole so as to rigidly mount the fixed element on a wall.

* * * * *